US008731421B2

(12) United States Patent
Pohlt et al.

(10) Patent No.: US 8,731,421 B2
(45) Date of Patent: May 20, 2014

(54) METHOD AND APPARATUS TO OPTIMIZE THE TRANSFER OF DEVELOPER FLUID IN AN ELECTROPHORETIC PRINTING APPARATUS

(75) Inventors: Michael Pohlt, Munich (DE); Martin Berg, Poing (DE); Gunnar Raschke, Munich (DE)

(73) Assignee: Océ Printing Systems GmbH, Poing (DE)

( * ) Notice: Subject to any disclaimer, the term of this patent is extended or adjusted under 35 U.S.C. 154(b) by 466 days.

(21) Appl. No.: 13/087,592

(22) Filed: Apr. 15, 2011

(65) Prior Publication Data

US 2011/0255893 A1 Oct. 20, 2011

(30) Foreign Application Priority Data

Apr. 16, 2010 (DE) ..... 10 2010 016 494

(51) Int. Cl.
*G03G 15/16* (2006.01)

(52) U.S. Cl.
USPC ..... 399/66; 399/57; 399/233; 399/237; 399/238; 399/239; 399/251

(58) Field of Classification Search
USPC ..... 399/57, 66, 233, 237, 238, 239, 251
See application file for complete search history.

(56) References Cited

U.S. PATENT DOCUMENTS

| | | | | |
|---|---|---|---|---|
| 5,352,557 | A | 10/1994 | Matsuoka et al. | |
| 5,555,185 | A | 9/1996 | Landa | |
| 5,998,081 | A | 12/1999 | Morrison et al. | |
| 6,261,732 | B1 * | 7/2001 | Morrison et al. | 430/117.3 |
| 7,463,851 | B2 | 12/2008 | Berg et al. | |
| 2008/0279597 | A1 | 11/2008 | Berg et al. | |

FOREIGN PATENT DOCUMENTS

| | | | |
|---|---|---|---|
| DE | 10 2005 055 156 | B3 | 5/2007 |
| WO | 2005/013013 | A2 | 2/2005 |

* cited by examiner

*Primary Examiner* — Ryan Walsh
(74) *Attorney, Agent, or Firm* — Schiff Hardin LLP

(57) ABSTRACT

In a method or apparatus to optimize transfer of a developer fluid having toner embedded in a carrier fluid in an electrophoretic printing apparatus, charge images of print images are generated on an intermediate image carrier. The print images are inked into toner images by means of a developer station with the developer fluid. The toner images are transfer printed onto a printing substrate in a transfer printing zone by a transfer unit. The toner embedded in the carrier fluid is thus transported from the developer station to the intermediate image carrier in a first transport path segment and from the transfer unit to the printing substrate in a second transport path segment. A temperature acting on the carrier fluid in the first transport path segment is above a melting point of the carrier fluid, and a temperature acting on the carrier fluid in the second transport path segment is below the melting point of the carrier fluid.

5 Claims, 1 Drawing Sheet

METHOD AND APPARATUS TO OPTIMIZE THE TRANSFER OF DEVELOPER FLUID IN AN ELECTROPHORETIC PRINTING APPARATUS

BACKGROUND

For single-color or multicolor printing of a printing substrate—for example a single page or a belt-shaped recording material made of the most varied materials, for example paper or thin plastic films or metal films—it is known to generate image-dependent charge images on an intermediate image carrier (for example a photoconductor), the charge images corresponding to the images to be printed, and the images being comprised of regions that are to be inked and regions that are not to be inked. The regions of the charge images that are to be inked are revealed with toner as toner images on the intermediate image carrier with a developer station. The toner images thereby generated are transfer-printed onto the printing substrate in a transfer printing zone and are fixed there.

A developer fluid having at least charged toner and carrier fluid can thereby be used to ink the charge images. Possible carrier fluids are hydrocarbons, among others.

A method for such an electrophoretic printing in digital printing systems is known from WO 2005/013013 A2 (US 2006/0150836 A1, DE 10 2005 055 156 B3), for example. After the charge images of the images to be printed have been generated on the intermediate image carrier, these are inked with toner into toner images via a developer station. For this purpose a developer fluid consisting of a carrier fluid containing silicone oil and colored particles (toner) dispersed therein is used. The feed of the developer fluid to the intermediate image carrier can take place via a developer roller to which the developer fluid is supplied via a raster roller at which a chamber blade is arranged. The toner images are subsequently accepted by a transfer unit from the intermediate image carrier and are transferred onto the printing substrate in a transfer printing zone.

In this printing method, using developer fluid the process of electrophoresis is thus used to transfer toner in the carrier fluid to the printing substrate via transport units. The solid, electrically charged toner thereby travels via the carrier fluid as a transport means from one transport unit to the next, wherein the transport can be controlled by an electrical field between the transport units. The film of carrier fluid divides after the contact region (nip) between the respective transport units in the depleted region, such that the toner is deposited with high efficiency on the target transport unit. In addition to the toner charge and the electrical field, the provision of a sufficiently thick carrier fluid layer through which toner can travel is a requirement for this. Rotating rollers can be used as transport units, for example.

The separation characteristics of the film of developer fluid and the electrophoretic migration velocity of the toner in the carrier fluid depend on the physical properties of the carrier fluid, in particular on its viscosity. The optimal viscosity can thereby differ for different transfer steps. The transfer of the developer fluid from the developer station to the transfer printing zone in the electrophoresis process requires a carrier fluid with low viscosity since the toner should respectively travel to a target transport unit. The relationships in the transfer printing of the toner image onto the printing substrate in the transfer printing zone are different. Problems in particular occur here. The transfer of the toner image to the printing substrate is affected by pores and roughness in the printing substrate surface (for example paper). The pores in the printing substrate draw carrier fluid from its surface into said printing substrate, with the consequence that the adhesion of the toner images to the printing substrate is reduced. The roughness in the surface of the printing substrate provides for an air gap between the transport unit (transfer roller) from which the toner image should be transferred and the printing substrate. The adhesion of the toner image to the printing substrate is also thereby reduced and the transfer printing is hindered.

One method to reduce this problem is the transfusion method according to U.S. Pat. No. 5,555,185. Carrier fluid is thereby no longer used as a transport means in the transfer printing of the toner images to the printing substrate. Instead of this, the toner is softened by high temperatures in the transfer unit and then is adapted with pressure to the printing substrate. A large common surface between printing substrate and toner image with strong adhesion forces thereby arises. Due to these surface forces, the toner is transferred from the transport unit onto the printing substrate in the transfer unit, although the carrier fluid is not used as a transport means.

A developing process in an electrophotographic printing apparatus is known from U.S. Pat. No. 5,998,081 A. Developer that is present in solid form is filled into a developer station. The developer and the carrier in the developer as well have a melting point that is above 25° C.—room temperature is in a range from 20 to 25° C. In order to liquefy the developer, this must be heated. This must take place before the development of the charge images. After the development of the charge images on the charge image carrier into toner images, the transport of the toner images no longer takes place in carrier fluid. The transfer printing of the toner images onto a printing substrate is executed not in carrier fluid but rather using pressure.

U.S. Pat. No. 5,352,557 A describes the design of developer fluid whose carrier fluid is selected such that environmental contamination and fire risk are minimized, in particular in the fixing.

SUMMARY

It is an object to specify a method to operate a digital electrophoretic printing apparatus in which the transport of the toner image to the printing substrate takes place in the carrier fluid.

In a method or apparatus to optimize transfer of a developer fluid having toner embedded in a carrier fluid in an electrophoretic printing apparatus, charge images of print images are generated on an intermediate image carrier. The print images are inked into toner images by means of a developer station with the developer fluid. The toner images are transfer printed onto a printing substrate in a transfer printing zone by a transfer unit. The toner embedded in the carrier fluid is thus transported from the developer station to the intermediate image carrier in a first transport path segment and from the transfer unit to the printing substrate in a second transport path segment. A temperature acting on the carrier fluid in the first transport path segment is above a melting point of the carrier fluid, and a temperature acting on the carrier fluid in the second transport path segment is below the melting point of the carrier fluid.

DESCRIPTION OF THE PREFERRED EMBODIMENTS

Figure 1:
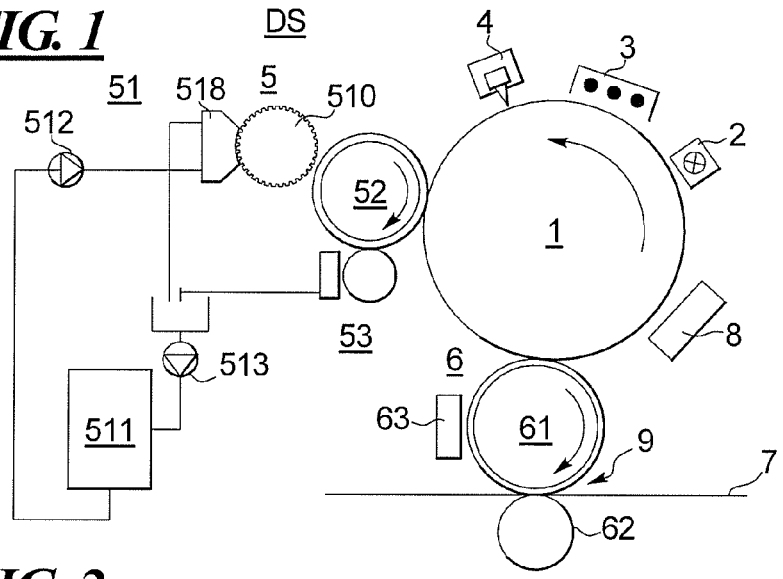
FIG. 1 illustrates a principle representation of a prior art electrophoretic printing apparatus.

For the purposes of promoting an understanding of the principles of the invention, reference will now be made to a preferred method and apparatus embodiments/best mode illustrated in the drawings and specific language will be used to describe the same. It will nevertheless be understood that no limitation of the scope of the invention is thereby intended, and such alterations and further modifications in the illustrated methods and such further applications of the principles of the invention as illustrated as would normally occur to one skilled in the art to which the invention relates are included.

In the method according to a preferred embodiment for transferring a developer fluid in an electrophoretic printing apparatus from a developer station to the printing substrate with the aid of transport units, between the transport units the developer fluid is fed through in order to transfer developer fluid from one transport unit to the next transport unit. The temperature acting on the developer fluid is selected per segment so that the viscosity of the carrier fluid required for the transfer of the developer fluid from one transfer unit to the next is optimized. In addition to this, in the transfer-printing of the toner images onto the printing substrate the viscosity of the carrier fluid is set so that the carrier fluid does not penetrate into the printing substrate and the transfer of the toner images onto the printing substrate can take place in sufficient carrier fluid.

The printing apparatus according to the preferred embodiments therefore has the following advantages:

- the conditions for an electrophoretic transfer of the toner are maintained;
- the requirement for carrier fluid is minimized;
- the dependency of the transfer printing of the toner images on the printing substrate is reduced; and
- the volatility of the carrier fluid at room temperature is reduced so that measures to avoid drying of toner, suction of carrier fluid vapor and to avoid sedimentation are omitted.

In comparison to the transfusion method, the following advantages exist:

- no deterioration of the transport unit in the transfer unit (for example the transfer roller) due to high heat;
- no contamination of the transfer roller due to contents from the printing substrate;
- simpler cleaning of the residual image on the transfer roller; and
- lower maintenance cost and material costs.

The preferred, exemplary embodiments are shown in the drawing figures.

FIG. 1 shows the components of an electrophoretic printing apparatus DS. The design and function of the printing apparatus DS is known and can be learned from WO 2005/013013 A2 or DE 10 2005 055 156 B3 (US 2006/0150836 A1), for example, the contents of which are incorporated into the disclosure. In FIG. 1, a regeneration exposure 2, a charging station 3, an exposure head 4, a developer station 5, a transfer unit 6 to transfer-print the developed charge images onto a printing substrate 7, and an element 8 to clean the photoconductor drum 1 are arranged along a rotating intermediate image carrier 1 (a photoconductor drum in FIG. 1).

The developer station 5 has the feed device 51 for the developer fluid, the developer unit 52 and optionally a cleaning device 53. The developer unit 52 can be a rotating developer roller or a developer belt arranged in contact with the intermediate image carrier 1. With the developer roller 52, charge images arranged on the intermediate image carrier 1 are developed into toner images. For this a developer fluid made up of at least a carrier fluid and electrically charged toner is used. The feed device 51 can have an inking roller 510 that applies the developer fluid onto the developer roller 52, wherein the inking roller 510 receives the developer fluid (via a chamber blade 518, for example) from a mixing unit 511 via a pump 512 and excess developer fluid are supplied to the mixing unit 511 again via a pump 513. The cleaning device 52 can be a cleaning roller on which a blade rests that scrapes off developer fluid (cleaned off of the developer roller 52) from the cleaning roller and supplies it to the mixing unit 511. The transfer unit 6 has (in a known manner) a transfer roller 61 and a counter-pressure roller 62. A cleaning means 63 for the transfer roller 61 can additionally be provided.

The transport units participating in the transport of the developer fluid from the developer station 5 to the printing substrate 7 are, for example, the developer roller 52, the intermediate image carrier 1 and the transfer unit 6. Rotating rollers—thus for example the developer roller 520, the photoconductor drum 1, and the transfer roller 61—can respectively be used as transport units for the developer fluid. Before the transfer roller 61, the developer fluid is transfer-printed onto the printing substrate 7 with the toner images in the transfer printing zone 9. In the following explanation of the preferred embodiment, rotating rollers are used as transport units—however, the preferred embodiments are not limited to these; belts can also be used as transport units.

In the transport of the developer fluid from the developer roller 52 to the printing substrate 7, the toner in the carrier fluid travels from transport unit to transport unit up to the transfer printing zone 9; in the transfer printing zone 9 the toner images then travel in the carrier fluid to the printing substrate 7. The viscosity of the carrier fluid thereby plays a large role: the lower the viscosity of the carrier fluid, the more mobile the toner in the carrier fluid.

The transfer printing of the toner images onto the printing substrate 7 is thereby particularly a problem since here difficulties occur due to the roughness or the pores in the printing substrate, for example. In order to avoid these problems, the thermodynamic properties of the carrier fluid are utilized in order to achieve better wetting properties at the surface of the printing substrate 7 in the transfer to the printing substrate 7. If the carrier fluid is cooled, upon approaching the phase transition the viscosity of the carrier fluid increases very significantly from fluid to solid in order to diverge at the melting point. In many hydrocarbons that are very frequently used as a carrier fluid, the melting point at atmospheric pressure lies in a range from 0° C. to 40° C. depending on what chain length of the hydrocarbon molecule is used. If the printing substrate 7 with a low temperature below or near the melting point of the carrier fluid now enters into the transfer printing zone 9, the temperature of the developer fluid in the transfer unit 6 is above (but not far above) the melting point, and the viscosity of the carrier fluid in the transfer printing zone 9 can be adjusted in a wide range with a small temperature change.

If the carrier fluid has a high viscosity—a more viscous carrier fluid film therefore being present—the carrier fluid is absorbed less quickly into the pores in the printing substrate 7. Due to the relatively short time that the toner images are provided for transfer printing in the transfer printing zone 9, the loss of carrier fluid into the printing substrate 7 can therefore be reduced. The carrier fluid can simultaneously be adjusted for the optimal wetting capability of the printing substrate 7 without an interfering penetration behavior of the carrier fluid into the printing substrate 7 being involved. The adhesion between carrier fluid and printing substrate 7 can therefore be used to improve the transfer printing. Specifically given a rough printing substrate 7, even in the case of depressions the toner can be drawn over from the transfer roller 61 onto the printing substrate 7. The cohesion of the developer fluid is strongly increased, and the toner can be transferred from the transfer roller 61 onto the printing substrate 7 even above depressions in the surface of the printing substrate 7.

Figure 2:
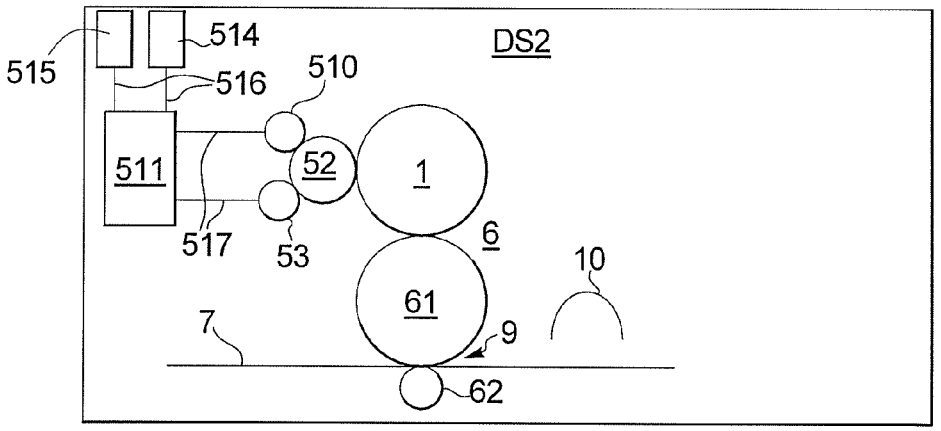
FIG. 2 shows a first method and apparatus embodiment of the printing apparatus.
Figure 3:
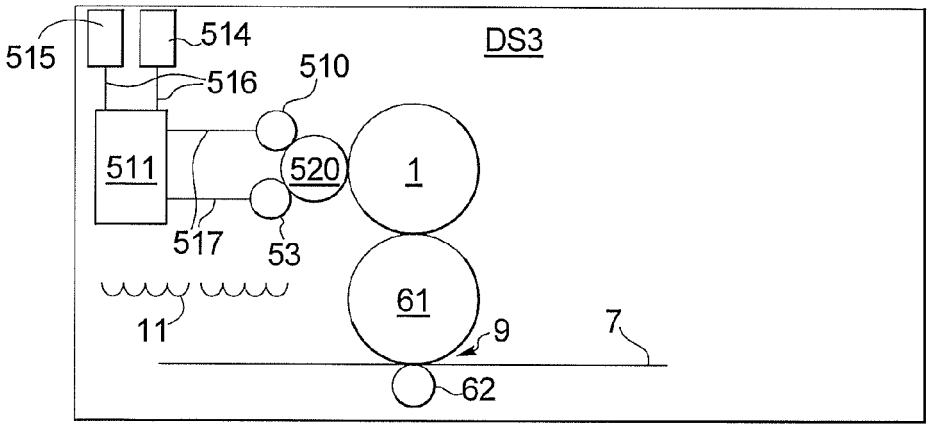
FIG. 3 shows a second method and apparatus embodiment of the printing apparatus.

Two paths that are shown in FIGS. 2 and 3 can be followed to realize the method.

Corresponding to the printing apparatus DS in FIG. 1, in principle a printing apparatus DS2 is shown in FIG. 2 whose components essentially corresponding to those of FIG. 1; identical components are therefore provided with the same reference characters. FIG. 2 provides:

an intermediate image carrier 1, a developer station 5 with a developer roller 52; with an application unit 510 for the developer fluid; with a mixing unit 511; with conduits 516 to feed toner and carrier fluid from reservoirs 514, 515 for toner and carrier fluid to the mixing unit 511; with a cleaning device 53 to clean the residual image from the developer roller 52; with connections 517 between mixing unit 511 and application unit 510 and cleaning device 53, a transfer unit 6 with a transfer roller 61 and with a counter-pressure roller 62.

The function of the individual components has been described in FIG. 1; this is referenced.

At least the application unit 510, the developer roller 52, the intermediate image carrier 1 and the transfer roller 61 are used as transport units. These transport units transport the carrier fluid with the toner to the printing substrate 7. The toner in the carrier fluid thereby respectively travels to the next transport unit and ultimately to the printing substrate 7.

In FIG. 2 the printing substrate 7 is cooled to room temperature before entering into the transfer printing zone 9. For this a cooling unit 10 that cools the printing substrate 7 is arranged adjacent to the printing substrate 7. The entire printing process can then proceed at room temperature from the developer station 5 to the transfer printing zone 9. For this a hydrocarbon with a melting point below room temperature is used as a carrier fluid, such that in the printing process up to the transfer printing zone 9 it is liquid with sufficiently low viscosity but at the transfer printing onto the transfer printing zone 9 it is set at a target temperature that produces a significant increase in the viscosity upon contact with the printing substrate 7. For example, tetradecane ($C_{14}H_{30}$), with a melting point of 5.5° C., can be cited as an example of a carrier fluid with these properties.

The design of the printing apparatus DS3 according to FIG. 3 corresponds to that of FIG. 2, except that, in contrast to FIG. 2, here the printing substrate 7 is printed at room temperature. In this exemplary embodiment the carrier fluid has its melting point just above room temperature. In the printing process the printing apparatus DS3 is heated from the developer station 52 to the transfer printing zone 9 so that the carrier fluid has a sufficiently low viscosity in order to ensure the mobility of the toner in the carrier fluid. All components that participate in the development of the charge image and in the transport of the developer fluid—for example the mixing unit 511, the conduit system 516, 517, the application unit 510, the developer roller 52, the photoconductor 1—are accordingly kept at a temperature sufficiently far above the melting point of the carrier fluid by a heating unit 11. In contrast to this, the printing substrate 7 is at room temperature, and therefore the carrier fluid in the transfer printing zone 9 is cooled by the printing substrate 7 (which is at room temperature), with the result that the carrier fluid achieves a higher viscosity (thus becomes more viscous). Here heptadecane ($C_{17}H_{36}$), with a melting point at 21° C., can be cited as an example of a carrier fluid.

In both embodiments of the invention the viscosity of the carrier fluid is kept very low (primarily in the inking of the latent image on the photoconductor 1), such that the mobility of the toner is sufficient to avoid deposition in the non-image areas and for a complete deposition in the image areas. In contrast to this, in the transfer printing zone 9 the viscosity of the carrier fluid is increased so far that the transfer of the toner images onto the printing substrate 7 is such that as much toner as possible is transferred and as little carrier fluid as possible is drawn into the printing substrate 7.

A targeted adjustment capability of the viscosity of the carrier fluid can thus be applied to all transfer zones occurring in the process, wherein the conditions for the electrophoretic and the gap response of the developer fluid film can be adjusted on the path to the transfer printing zone 9 and at the transfer printing onto the printing substrate 7.

Although preferred exemplary embodiments are shown and described in detail in the drawings and in the preceding specification, they should be viewed as purely exemplary and not as limiting the invention. It is noted that only preferred exemplary embodiments are shown and described, and other embodiments may be provided, and all variations and modification that presently or in the future lie within the protective scope of the invention should be protected.

We claim as our invention:

1. A method to optimize transfer of a developer fluid having toner embedded in a carrier fluid in an electrophoretic printing apparatus, comprising the steps of:

generating charge images of print images being generated on an intermediate image carrier, the print images being inked by electrophoresis into toner images by a developer station with the developer fluid wherein the toner has mobility in the carrier fluid to travel through the carrier fluid onto the image carrier, the toner embedded in the carrier fluid being transported from the developer station to the intermediate image carrier in a first transport path segment;

transfer printing the toner images onto a printing substrate at a transfer printing zone by electrophoresis wherein the toner has mobility in the carrier fluid to travel through the carrier fluid onto the substrate, a portion of the carrier fluid depositing on the substrate and into pores of the substrate, the toner embedded in the carrier fluid being transported from the intermediate image carrier to the printing substrate in a second transport path segment;

providing a temperature acting on the carrier fluid in the first transport path segment above a melting point of the carrier fluid to provide a first viscosity of the carrier fluid in said first transport path; and providing a temperature acting on the carrier fluid at the transfer printing zone below the melting point of the carrier fluid by setting a temperature of the printing substrate below the melting point of the carrier fluid by cooling the substrate before the substrate reaches the transfer printing zone so that a desired second viscosity of the carrier fluid at the transfer printing zone is provided which is greater than the first viscosity to reduce the portion of the carrier fluid deposited in said pores but still providing a desired wetting of said substrate by said portion of the carrier fluid for transfer of the toner images onto the substrate.

2. The method of claim 1 wherein a transfer unit transfers the toner images from the intermediate image carrier to the transfer printing zone in said second transport path segment.

3. The method according to claim 1 in which hydrocarbons having a melting point in a range from 0° C. to 40° C. at atmospheric pressure are selected as the carrier fluid.

4. An electrophoretic printing apparatus, comprising:

an intermediate image carrier having an exposure head to create charge images on the intermediate image carrier, and a developer station with developer fluid having toner embedded in a carrier fluid, said developer station inking by electrophoresis the charge images on the intermediate image carrier wherein the toner has mobility in the carrier fluid to travel through the carrier fluid onto the image carrier, and a transfer printing zone where the inked toner images are transferred to a printing substrate by electrophoresis wherein the toner has mobility in the carrier fluid to travel through the carrier fluid onto the substrate, a portion of the carrier fluid being deposited on the substrate and into pores of the substrate;

the toner embedded in the carrier fluid being transported from the developer station to the intermediate image carrier in a first transport path segment and from the intermediate image carrier to the printing substrate in a second transport path segment;

a temperature of the carrier fluid in the first transport path segment being above a melting point of the carrier fluid to provide a first viscosity of the carrier fluid in said first transport path; and a cooling unit for cooling the substrate to a temperature below the melting point of the carrier fluid before the substrate reaches the transfer printing zone to provide a desired second viscosity of the carrier fluid at the transfer printing zone which is greater than the first viscosity to reduce the portion of the carrier fluid deposited in said pores but still providing a desired wetting of said substrate by said portion of the carrier fluid for transfer of the toner images onto the substrate.

5. The apparatus of claim 4 wherein a transfer unit is provided between the intermediate image carrier and the transfer printing zone.

* * * * *